United States Patent [19]

Chard

[11] Patent Number: 4,630,618

[45] Date of Patent: Dec. 23, 1986

[54] APPARATUS AND METHOD FOR FORMING A ROD OF SMOKEABLE MATERIAL

[75] Inventor: Brian C. Chard, Bristol, England

[73] Assignee: Imperial Group PLC, England

[21] Appl. No.: 519,317

[22] Filed: Aug. 1, 1983

[30] Foreign Application Priority Data

Aug. 5, 1982 [GB] United Kingdom ..... 8222638

[51] Int. Cl.[4] ..... A24C 5/18

[52] U.S. Cl. ..... 131/84.3; 131/84.1

[58] Field of Search ..... 131/84 C, 84 B, 84 R, 131/84 A, 364, 84.1, 84.2, 84.3, 84.4

[56] References Cited

U.S. PATENT DOCUMENTS

| | | | |
|---|---|---|---|
| 3,736,941 | 6/1973 | Molins et al. | 131/84 B |
| 3,759,267 | 9/1973 | Thornton | 131/364 |
| 3,880,171 | 4/1975 | Naylor | 131/84 C |
| 3,987,804 | 10/1976 | Molins et al. | 131/84 B |
| 4,434,804 | 3/1984 | Bolt et al. | 131/364 |

FOREIGN PATENT DOCUMENTS

| | | |
|---|---|---|
| 2259814 | 12/1971 | Fed. Rep. of Germany . |
| 1445096 | 8/1976 | Fed. Rep. of Germany . |
| 2923201 | 6/1978 | Fed. Rep. of Germany . |
| 2942119 | 4/1981 | Fed. Rep. of Germany . |
| 1340100 | 12/1973 | United Kingdom . |
| 1443402 | 7/1976 | United Kingdom . |
| 1473300 | 5/1977 | United Kingdom . |
| 1475495 | 6/1977 | United Kingdom . |
| 1475494 | 6/1977 | United Kingdom . |
| 1522026 | 8/1978 | United Kingdom . |
| 2064295 | 6/1981 | United Kingdom . |

*Primary Examiner*—V. Millin

*Attorney, Agent, or Firm*—Larson and Taylor

[57] ABSTRACT

Apparatus and method of forming a rod of tobacco from two types of tobacco in which the two types are stored in a hopper and separated therein by a partition, and deposited on an air pervious conveyor belt so that one type overlies the other type. Deposition of one type on the belt is periodically inhibited in favor of the other type by means of an air jet directed at the belt.

12 Claims, 7 Drawing Figures

APPARATUS AND METHOD FOR FORMING A ROD OF SMOKEABLE MATERIAL

This invention relates to the manufacture of a rod of smokeable material, such as is used in cigarettes, and is concerned with the production of a rod in which the smokeable material consists of more than one type of smoking material, in particular a rod in which the types of smoking material are demarcated. The types of smoking material envisaged in the present invention include those exhibiting different natures or compositions and may, for instance, comprise various types of tobacco, tobacco products such as reconstituted tobacco, or tobacco substitutes. For the purposes of this invention, "tobacco substitute" includes not only smokeable materials such as cellulose derivatives but inert fillers such as alumina.

It is known in prior art German Pat. No. 2259814 to provide a cigarette making machine for making cigarettes consisting of two demarcated smoking materials of different compositions. The machine of the prior art includes a vacuum conveyor, two charging appliances for the smoking materials, one of the charging appliances being provided with devices for imparting shape to the tow of one of the smoking materials when on the conveyor, and devices for the removal of surplus material. The smoking material supplied to each charging appliance and further conveyed to the conveyor belt is controlled by two cutting and return devices, one for each charging appliance. The cutting devices are profiled disc cutters. There are further provided a blow separating device, a cleaning disc and a vibratory conveyor capable of dealing with 50% or more excess material. A disadvantage of the machine of German Pat. No. 2259814 is that there is appreciable degradation of material by the cutting and return devices.

The present invention utilises conventional cigarette making machinery, such as the Molins "Mark 8", with a conventional charging device and a vacuum conveyor, but renders unnecessary the trimming or removal of the first deposited material from the vacuum conveyor, thereby obviating the degradation and return of the material.

According to a first aspect of the present invention there is provided an apparatus for forming a rod of smokeable material from at least two types of smoking material comprising storage means for storing said at least two types of smoking material, an air pervious conveyor belt, a vacuum source located on one side of the belt, means located on the other side of the belt for depositing first and second types of smoking material respectively on the belt so that the second type of smoking material overlies the first type, and gate means to allow predetermined amounts of the second type of smoking material to be periodically deposited on the belt.

The storage means preferably comprises a hopper provided with at least one partition separating said at least two types of smoking material into at least two streams.

The means for depositing the types of smoking material is preferably an air entrainment chimney directed upwardly at the underside of the lower run of the belt.

The gate means is preferably provided by an air jet directed at the underside of the belt opposed to the side of the belt on which smoking material is to be deposited so as to cancel out the suction effect of the vacuum over the region of the belt at which the jet is directed, and to cancel out the momentum of the smoking material stream created by the belt, thereby to prevent deposition or retention of smoking material on the belt in that region.

According to a second aspect of the present invention there is provided a method of forming a rod of smokeable material from at least two types of smoking material comprising depositing first and second types of smoking material onto an air pervious conveyor belt so that the second type of smoking material overlies the first type, and interrupting deposition of the first type so as to allow predetermined amounts of the second type to be deposited periodically on the belt.

The invention will now be described by way of example only with reference to the accompanying diagrammatic drawings in which.

Figure 1:
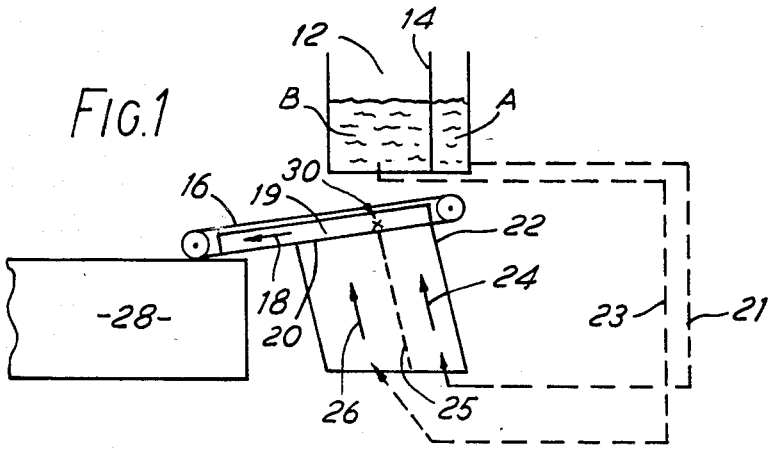
FIG. 1 is a side view of a portion of a conventional cigarette rod making machine, showing a partitioned hopper, the location of a gate means, and a conveyor belt.

Referring to FIG. 1 there is shown in outline a portion of a conventional cigarette making machine 10, such as the Molins "Mark 8", modified according to the invention. The machine includes a tobacco rod cutting knife and a filter plug assembly mechanism, both of which are well-known and are not illustrated.

There is provided a charging hopper 12 adapted to contain separately two different types of tobacco, A and B, by means of a vertical partition 14 dividing the hopper into two compartments.

There is provided an air pervious vacuum conveyor belt 16 running in the direction of arrow 18, vacuum being applied to the top surface of the lower run 20 of the belt by a vacuum source.

Both types of tobacco are conveyed from the hopper 12 to an upwardly directed air entrainment chimney 22 that is directed at the underside of the lower run 20 of the belt, by a conventional carding conveyor shown diagrammatically at 21,23 leading from the hopper to the base of the chimney.

At the chimney the two types of tobacco A and B are entrained in an air stream and proceed upwardly through the chimney in two parallel streams 24,26 corresponding to the respective types A and B. The boundary layer between the streams is indicated by chain line 25. The tobacco is held on the underside of the lower run 20 of the belt by virtue, of the vacuum applied to the belt from vacuum box 19 and is carried in the direction of arrow 18 to the remainder of the cigarette making machine indicated generally at 28, where it is formed into a rod of tobacco and enclosed in cigarette paper, in a known manner.

It will be observed that when the tobacco ascends the chimney and is laid on the belt type A from stream 24 is laid first and is then overlaid by type B from stream 26.

Figure 2:
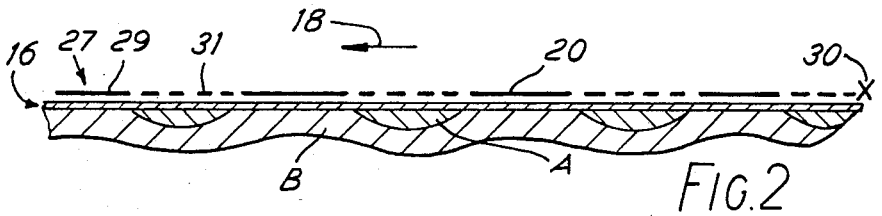
FIG. 2 is a section of the conveyor belt shown in FIG. 1 showing a typical configuration of two types of smoking material on the conveyor belt.

A timed gate means is located adjacent the lower run 20 of the belt at a point 30 where the boundary 25 between the streams 24 and 26 meets the lower run 20. The effect of the gate means is to block periodically the carriage of tobacco type A on the belt and to permit type B to be deposited directly onto the belt. A typical configuration of types A and B on the lower run of the belt is shown in FIG. 2.

Figure 3:
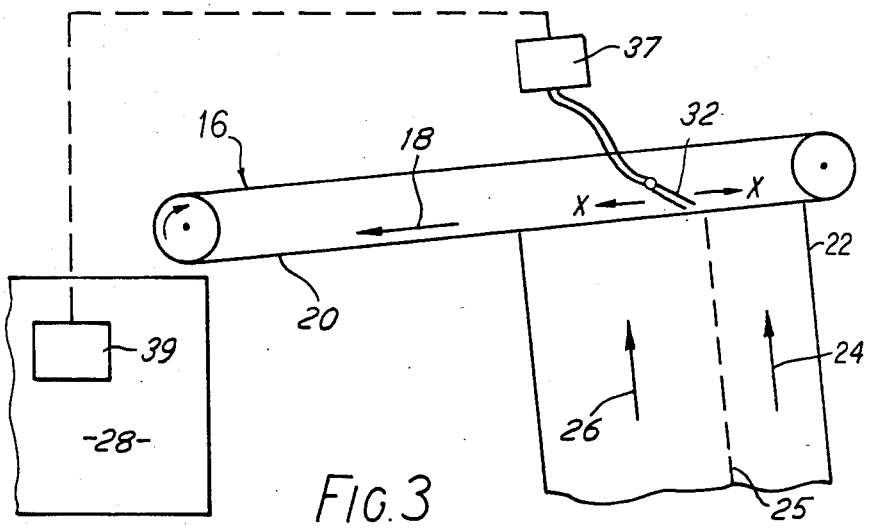
FIG. 3 is a cross-section of a preferred embodiment of a gate means used in conjunction with the conveyor belt of FIG. 1.

A preferred gate means for blocking the carriage of tobacco type A is shown in FIG. 3 which shows the belt 16, chimney 22, and an air jet 32 which is directed at an angle to the vertical at the junction of the boundary 25 with the lower run 20 of the belt against the direction of flow of tobacco up the chimney. The effect of the air jet is to neutralise the vacuum on the belt and the momentum of the tobacco at this point and thereby to prevent tobacco type A from passing the gate.

Figure 4:
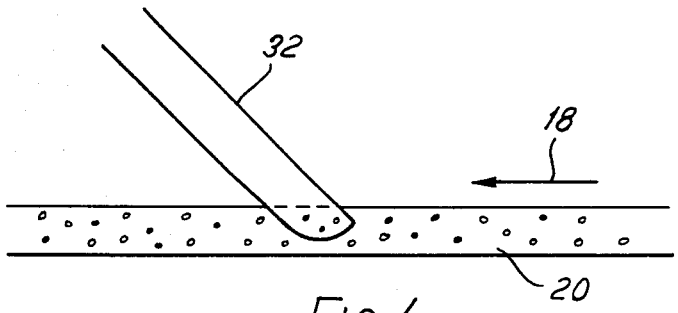
FIG. 4 is a detail view of a portion of FIG. 3.

FIG. 4 shows an enlarged view of the impingement of the jet on the belt. A typical air pressure for the jet will lie in the range 0.7 to 10.5 at.

The jet may be actuated by known mechanical or electrical timing devices 37 which will enable the on/-off cycle time of the jet to be controlled as required. The position of the jet along the belt may be varied (arrows X—X) to suit the ratio of the tobacco types A and B as determined by the position of the hopper partition. The relative amounts and configurations of types A and B on the belt can thus be easily controlled with minimum waste and degradation of the tobacco.

In use it is convenient that the timing means 37 for the jet be linked to the cutting knife and filter plug assembly 39 in the cigarette making machine 28 so that the knife cuts may be made at desired positions along the tobacco rod.

Figure 6:
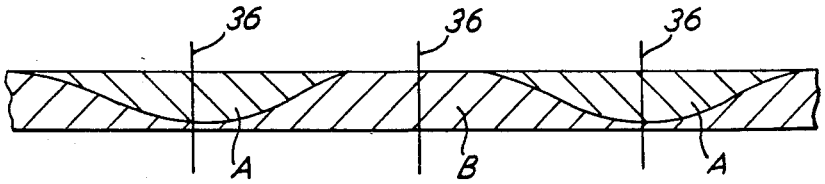
FIG. 6 is a section through a completed rod of smokeable material made according to the invention.

FIG. 6 shows a typical configuration of tobacco types A and B in a tobacco rod resulting from the invention and further shows typical positions of knife cuts 36.

Figure 7:
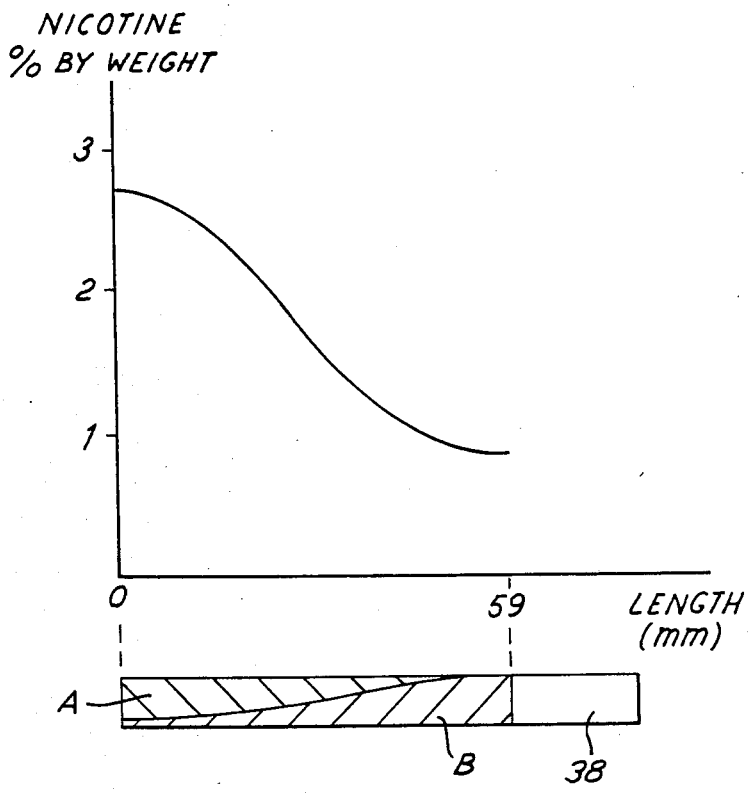
FIG. 7 shows a cross-section through a cigarette showing a possible configuration of smoking materials according to the invention, together with a graph of the nicotine content along the cigarette.

FIG. 7 shows an example of a cigarette according to the invention including a conventional filter tip 38. The cigarette contains two tobaccos of differing nature. One (type A) is a burley tobacco containing 3.43% nicotine and the other (type B) is a flue-cured tobacco containing 0.86% nicotine. The graph immediately above the drawing of the cigarette shows the overall percentage of nicotine along the length of the cigarette.

Figure 5:
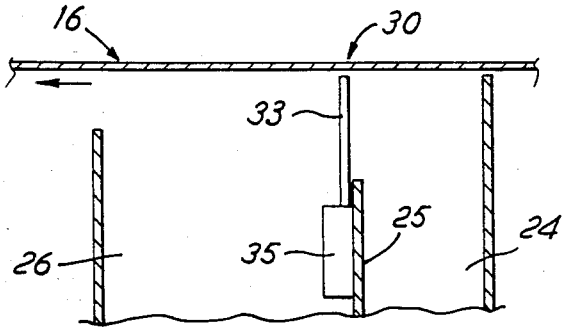
FIG. 5 shows a mechanical gate means.

Alternative gate means are possible. In one alternative embodiment shown in FIG. 5 the gate means may be provided by a gate 33 acting transversely of the belt 16 in a plane normal to that of the surface of the belt in the region of the boundary 25 between the types of tobacco so as to impede transport of type A along the belt. The gate may be operated by mechanical or electrical means 35.

In a second alternative embodiment of gate means, shown in FIG. 2, a moving continuous band 27 is interposed between the lower run 20 of the conveyor belt 16 and the vacuum source over a chosen length of the conveyor belt, the band being provided with at least one air pervious region 31 and at least one region 29 impervious to air, the arrangement being that suction to the conveyor belt from the vacuum source is cut off when an air impervious region of the band is adjacent the conveyor belt and suction to the conveyor belt is restored when an air pervious region of the band is adjacent the conveyor belt, whereby tobacco can accumulate only on those zones of the conveyor belt to which suction is applied through an air pervious region of the band.

I claim

1. Apparatus for forming a rod of smokeable material from at least two types of smoking material comprising storage means for storing said at least two types of smoking material, an air pervious conveyor belt, a vacuum source located on one side of the belt, means located on the other side of the belt for depositing first and second types of smoking material respectively on the belt so that the second type of smoking material overlies the first type, and gate means to interrupt the deposition of the first type of material and allow predetermined amounts of the second type of smoking material to be periodically deposited directly on the belt.

2. Apparatus as claimed in claim 1 wherein the storage means comprises a hopper provided with at least one partition separating said at least two types of smoking material into at least two streams

3. Apparatus as claimed in claim 1 wherein the means for depositing the types of smoking material is an air entrainment chimney directed upwardly at the underside of the lower run of the belt.

4. Apparatus as claimed in claim 1 wherein the gate means is provided by an air jet directed at the side of the belt opposed to the side of the belt on which smoking material is deposited so as to cancel out the suction effect of the vacuum over the region of the belt at which the jet is directed, and to cancel out the momentum of the smoking material stream created by the belt, thereby to prevent deposition or retention of smoking material on the belt in that region.

5. Apparatus as claimed in claim 1 including a timing device to control the operation of the gate means.

6. Apparatus as claimed in claim 5 wherein the timing device is coordinated with the operation of a knife for cutting the rod of smokeable material.

7. Apparatus as claimed in claim 2 wherein the position of said at least one partition is variable thereby to control the ratio of types of smoking material deposited on the belt.

8. Apparatus as claimed in claim 7 wherein the position of the gate means in relation to the belt is variable in accordance with the ratio of types of smoking material deposited on the belt.

9. Apparatus as claimed in claim 1 in which the gate means is provided by a gate acting transversely of the belt in a plane normal to that of the surface of the belt in the region of the boundary between the types of smoking material so as to impede transport of one type of smoking material along the belt.

10. Apparatus as claimed in claim 1 in which the gate means is provided by a moving continuous band interposed between the conveyor belt and the vacuum source over a chosen length of the conveyor belt, the band being provided with at least one air pervious region and at least one region impervious to air, the arrangement being that suction to the conveyor belt from the vacuum source is cut off when an air impervious region of the band is adjacent the conveycr belt and suction to the conveyor belt is restored when an air pervious region of the band is adjacent the conveyor belt, whereby tobacco can accumulate only on those zones of the conveyor belt to which suction is applied through an air pervious region of the band.

11. A method of forming a rod of smokeable material from at least two types of smoking material comprising propelling first (A) and second (B) types of smoking material in separate parallel streams through a chimney onto a moving air pervious conveyor belt so that the second type (B) of smoking material overlies the first type (A), directing an air jet at the interface of the streams with the belt, and interrupting deposition of the first type (A) periodically by means of the air jet so as to allow predetermined amounts of the second type (B) to be deposited periodically directly on the belt.

12. A method as claimed in claim 11 wherein the rod is cut at positions determined by the periodic deposition of the second type of smoking material on the belt.

* * * * *